US007461676B2

(12) United States Patent
Huie

(10) Patent No.: US 7,461,676 B2
(45) Date of Patent: Dec. 9, 2008

(54) HANDBAG WITH INTERCHANGEABLE LINER

(76) Inventor: Shawnee Huie, 12781 Diamond Path, Apple Valley, MN (US) 55124

( * ) Notice: Subject to any disclaimer, the term of this patent is extended or adjusted under 35 U.S.C. 154(b) by 24 days.

(21) Appl. No.: 11/431,418

(22) Filed: May 10, 2006

(65) Prior Publication Data

US 2006/0266452 A1 Nov. 30, 2006

Related U.S. Application Data

(60) Provisional application No. 60/679,727, filed on May 11, 2005.

(51) Int. Cl.
*A45C 3/08* (2006.01)
*A45C 13/02* (2006.01)

(52) U.S. Cl. ..... 150/105; 150/113; 190/110; 383/111

(58) Field of Classification Search ..... 150/103–105, 150/113; 383/111, 2; 190/110
See application file for complete search history.

(56) References Cited

U.S. PATENT DOCUMENTS

| | | | | | |
|---|---|---|---|---|---|
| 1,978,971 | A | * | 10/1934 | Thornhill et al. | 150/129 |
| 2,118,400 | A | * | 5/1938 | Goldberg | 150/105 |
| 2,332,808 | A | * | 10/1943 | Myers | 150/104 |
| 2,477,388 | A | * | 7/1949 | Moore | 150/112 |
| 2,529,724 | A | * | 11/1950 | Conwiser | 150/113 |
| 2,893,457 | A | * | 7/1959 | Wilson | 29/254 |
| 3,451,454 | A | * | 6/1969 | Davis | 150/113 |
| 4,260,004 | A | * | 4/1981 | Domke | 206/316.2 |
| 4,754,790 | A | * | 7/1988 | Meyers | 150/104 |
| 5,207,204 | A | | 5/1993 | Kawachi et al. | |
| 5,207,254 | A | * | 5/1993 | Fromm | 150/104 |
| 5,894,975 | A | | 4/1999 | Holden et al. | |
| 5,983,969 | A | * | 11/1999 | Morgan | 150/104 |
| 6,003,573 | A | | 12/1999 | Owens | |
| 6,029,723 | A | | 2/2000 | Baquero et al. | |
| 6,186,201 | B1 | | 2/2001 | Salz | |
| 6,237,660 | B1 | * | 5/2001 | Giardino | 150/105 |
| 6,971,424 | B1 | | 12/2005 | Angevine | |
| 7,028,730 | B2 | | 4/2006 | Pace et al. | |
| 2001/0015248 | A1 | * | 8/2001 | McCreery | 150/104 |
| 2003/0000612 | A1 | * | 1/2003 | Sutton | 150/105 |
| 2005/0274441 | A1 | | 12/2005 | Pace et al. | |
| 2006/0021684 | A1 | | 2/2006 | DeCoro, III | |

FOREIGN PATENT DOCUMENTS

WO WO 2006/050189 A2 5/2006

* cited by examiner

*Primary Examiner*—Sue A Weaver
(74) *Attorney, Agent, or Firm*—Patterson, Thuente, Skaar & Christensen, P.A.

(57) ABSTRACT

A handbag system for efficient changing of handbag styles. The handbag system can include a first outer shell, a second outer shell and a removable liner. The removable liner can be configured for removable placement and attachment within either the first outer shell and the second outer shell. The removable liner can be filled with the typical belongings of the user including a wallet, cosmetics, keys and the like. The removable liner can be detached and removed from the outer shell while retaining the belongings of the user. The user can use the removable liner with the outer shell deemed most appropriate for use with a particular outfit or activity. In addition, the first outer shell can have a first style matching a first outfit and the second outer shell can have a second style matching a second outfit so as to form a fashion system.

10 Claims, 3 Drawing Sheets

HANDBAG WITH INTERCHANGEABLE LINER

PRIORITY CLAIM

The present application claims priority to U.S. Provisional Patent Application Ser. No. 60/679,727 filed May 11, 2005 and entitled "HANDBAG WITH INTERCHANGEABLE LINER", which is herein incorporated by reference in its entirety.

FIELD OF INVENTION

The present invention relates generally to a handbag. More particularly, the present invention relates to an interchangeable liner for a handbag that can be quickly and easily transferred between handbag shells.

BACKGROUND OF INVENTION

Handbags are commonly used everyday as both an item of convenience and a fashion accessory. When using a handbag, such as, for example, a purse, it is preferable to possess a variety of different colors, materials and styles so as to be able to match a handbag with a particular clothing ensemble or activity. Unfortunately, it is often inconvenient and time consuming to switch between handbags as it typically involves cleaning out one's belongings from a first handbag and transferring them to a second handbag. Due to the time involved in transferring belongings between handbags, it is often the case that a user simply utilizes a single handbag, regardless of whether or not the handbag is appropriate for the outfit or activity.

As such it would be advantageous to have a handbag system that overcame the aforementioned disadvantages and inefficiencies of current handbag design.

SUMMARY OF THE INVENTION

The present disclosure is directed to a handbag system for efficient changing of handbag styles. The handbag system generally includes an outer shell and a removable liner. The removable liner is adapted for placement and attachment within the outer shell. The removable liner can be filled with the typical belongings of the user including a wallet, cosmetics, keys and the like. As desired by the user, the removable liner can be detached and removed from the outer shell while still retaining the belongings of the user. The removable liner can then inserted and attached within a variety of second outer shells having a different style that the user feels is more appropriate for use with a particular outfit or activity.

In one aspect, the present disclosure is related to a handbag system having a first outer shell, a second outer shell and a removable, interchangeable liner. The removable, interchangeable liner is adapted for placement within both the first outer shell and the second outer shell. The removable, interchangeable liner can include a liner attachment feature that operably attaches to a shell attachment feature on both the first outer shell and the second outer shell such that the removable, interchangeable liner is removably, retainably attached within the selected outer shell. In some embodiments, the removable, interchangeable liner can comprise a standardized size and/or liner attachment feature allowing the removable, interchangeable liner to be used with any number of additional outer shell designs and/or sizes.

In another aspect, the present disclosure is related to a method for quickly and efficiently transferring one's belongings between different handbag styles. A removable, interchangeable handbag liner including a person's belongings is removably attached to a first handbag outer shell having a first handbag style. The removable handbag liner including the belongings is detached and removed from the first handbag outer shell and can be positioned and attached within a second handbag outer shell having a second handbag style.

In another aspect, the present disclosure is related to a fashion system comprising a first outfit having a first clothing ensemble coordinating with a first outer shell, and a second outfit having a second clothing ensemble coordinating with a second outer shell. A removable, interchangeable handbag liner can be selectively removed and selectively inserted within either the first or second outer shell.

The above summary of the various representative embodiments of the invention is not intended to describe each illustrated embodiment or every implementation of the invention. Rather, the embodiments are chosen and described so that others skilled in the art may appreciate and understand the principles and features of the invention. The figures in the detailed description that follow more particularly exemplify these embodiments.

BRIEF DESCRIPTION OF THE DRAWINGS

These, as well as other objects and advantages of this disclosure, will be more completely understood and appreciated by referring to the following more detailed description of the presently preferred exemplary embodiments of the invention in conjunction with the accompanying drawings, of which.

Figure 1:
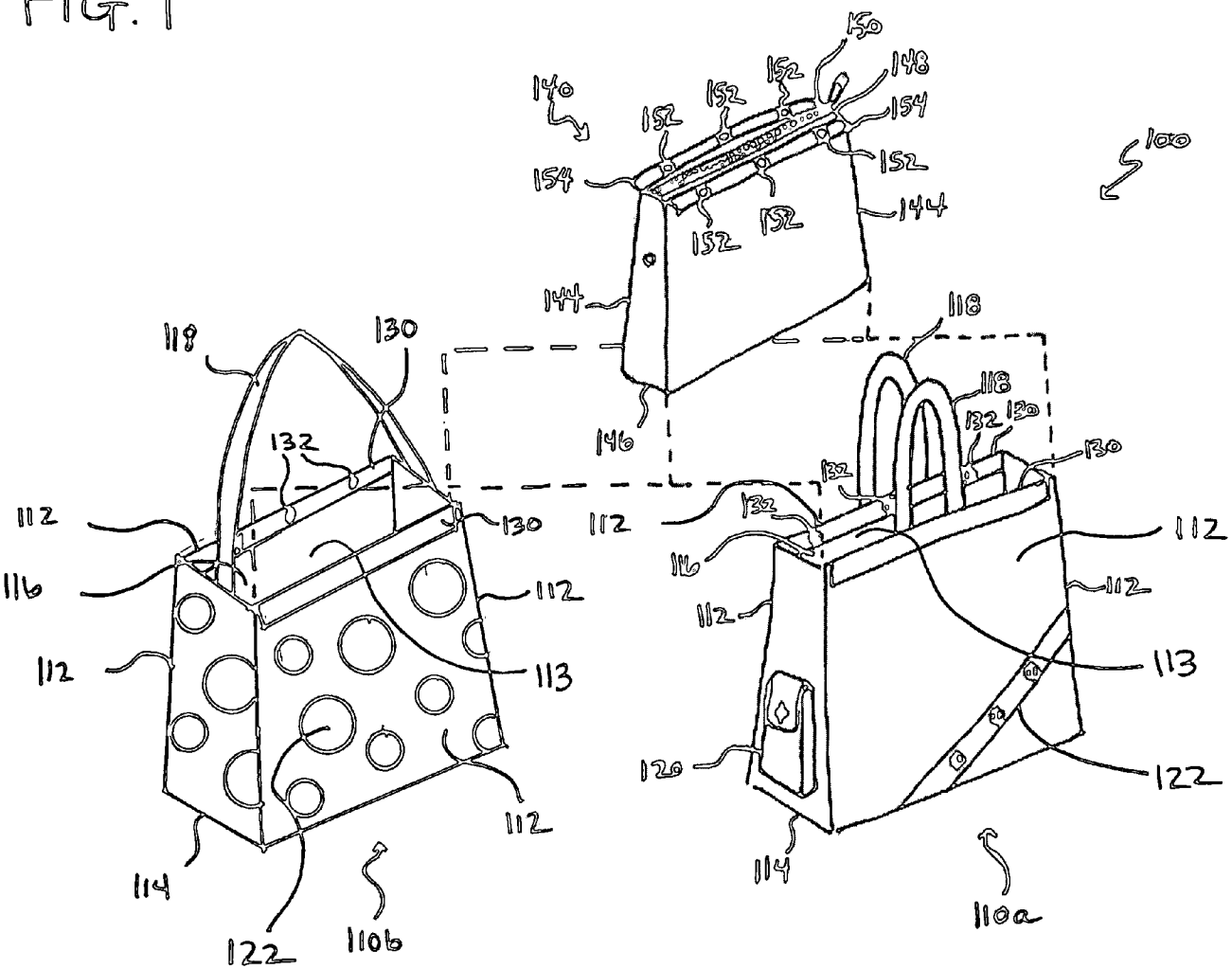
FIG. 1 is an exploded, perspective view of a handbag system with an interchangeable liner according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

A handbag system according to the present disclosure is shown generally at 100 in FIG. 1. Handbag system 100 can comprise a first outer shell 110*a*, a second outer shell 110*b*, and an inner liner 140.

First outer shell 110*a* and second outer shell 110*b* can both comprise a plurality of side panels 112 and bottom panel 114 defining a containment area 113 for the containment of personal items. Containment area 113 includes a top 116 open for access to the inside of outer shells 110*a* and 119*b*. First and second outer shells 110*a* and 110*b* can comprise additional features such as, for example, at least one handle 118, pockets 120, shoulder straps, decorative features 122, such as real and imitation gem stones, beads, patterns, and the like. First and second outer shells 110*a* and 110*b* can comprise an unlimited variety of shapes, sizes, colors, textures, prints and combinations thereof. First and second outer shells 110*a* and 110*b* can be constructed of any of a variety of natural and synthetic materials such as, for example, leather, suede, vinyl, silk, cotton, straw, hemp and any other suitable material as well as combinations thereof.

As illustrated in FIGS. 1, 2A, 2B, and 2C, each outer shell can comprise at least one shell attachment area 130, such as a flap or strip of material adjacent to side panel 112, or integral with side panel 112. Shell attachment area 130 can be located along at least one side panel 112. In a preferred embodiment, as illustrated in FIG. 1, first and second outer shells 110*a* and 110*b* comprise two shell attachment areas 130, each shell attachment area 130 located at the top of a side panel 112. Shell attachment area 130 can comprise a plurality of evenly spaced shell fasteners 132. Shell fasteners 132 can comprise snaps, buttons, ties, toggle-style fasteners, receiving apertures for liner fasteners such as ties, buttons, toggle-style fasteners, and the like, and other suitable fasteners. Preferably, shell fastener 132 is a toggle-style fastener.

Referring to FIG. 1, liner 140 can comprise a plurality of side panels 144, bottom panel 146, and top panel 148 for enclosing personal items placed within liner 140. Liner 140 can comprise an unlimited variety of shapes, sizes, colors, and combinations thereof so long as liner 140 fits within first and second outer shells 110*a* and 110*b*. Liner 140 can comprise a variety of materials such as, for example, leather, suede, vinyl, silk, cotton, other suitable materials, and combinations thereof.

Top panel 148 can include a closure member 150 such as, for example, zippers, fasteners such as snaps, buttons, and the like, and other suitable closing means for retainably enclosing personal items within liner 140. Liner 140 can comprise at least one liner attachment area 154, such as a flap or strip of material adjacent to side panel 144, or integral with side panel 144. In a preferred embodiment, as illustrated in FIG. 1, liner 140 comprises two liner attachment areas 154, each liner attachment area 154 comprising a flap located at the intersection of side panel 144 and top panel 148. Liner attachment area 154 can comprise a plurality of evenly spaced liner fasteners 152. Liner fasteners 152 can comprise snaps, buttons, ties, toggle-style fasteners, receiving apertures for shell fasteners such as ties, buttons, toggle-style fasteners, and the like, and other suitable fasteners. Preferably, liner fastener 152 is a receiving aperture for a toggle-style shell fastener 132.

In use, liner 140 is placed within the containment area 113 of first outer shell 110*a* or second outer shell 110*b*. Liner attachment area 154 and shell attachment area 130 are aligned such that shell fasteners 132 of first outer shell 110*a* or second outer shell 110*b* are mechanically engaged to liner fasteners 152 of liner 140 to selectively, removably attach liner 140 within either of first outer shell 110*a* or second outer shell 110*b*. Liner 140 can be interchanged within multiple outer shells 110*a* and 110*b*, as shown in FIG. 1, without requiring a user to transfer personal belongings. It is understood that liner 140 can be interchanged with any number of compatible outer shells, and not limited to first and second outer shells 110*a* and 110*b*. Alternatively, multiple liners 140 can be interchanged within first and second outer shells 110*a* or 110*b*.

Figure 2A:
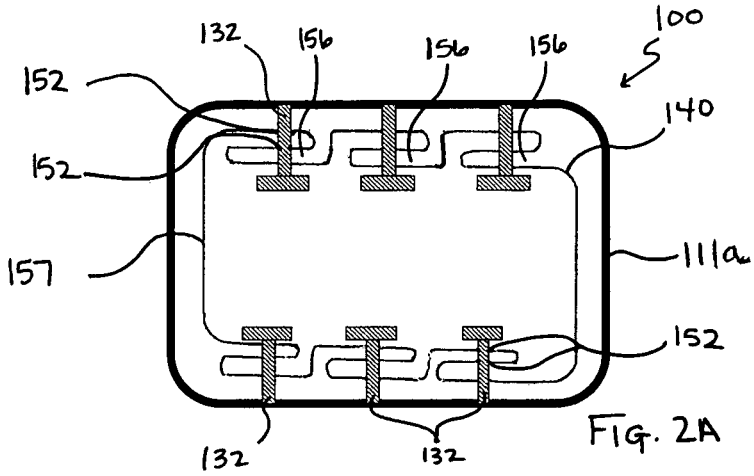
FIG. 2A is a top view of an interchangeable liner mounted in a small-size handbag according to an embodiment of the present invention.
Figure 2B:
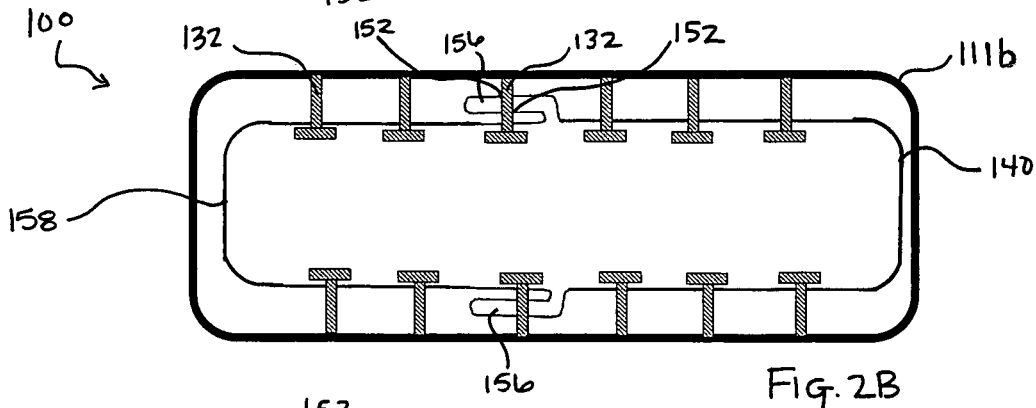
FIG. 2B is a top view of an interchangeable liner mounted in a medium-size handbag according to an embodiment of the present invention.
Figure 2C:
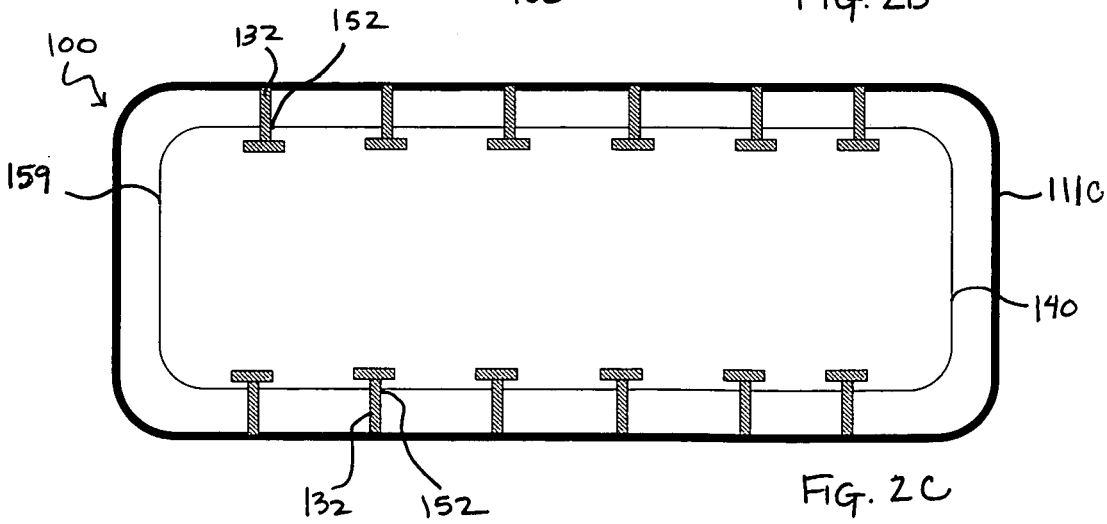
FIG. 2C is a top view of an interchangeable liner mounted in a large-size handbag according to an embodiment of the present invention.

As illustrated in FIGS. 2A, 2B, and 2C, an embodiment of liner 140 can comprise pleats 156 within a pleated liner attachment area 154. Upon folding of pleats 156, liner 140 can then be inserted within shells 110 with an attachment area 130 of substantially the same length as pleated liner attachment area 154. Upon unfolding of pleats 156, liner attachment area 154 lengthens and liner 140 can be inserted into different shells 110 with attachment areas 130 of various lengths. For example, FIG. 2A depicts liner 140 inserted into a small-size handbag outer shell 111*a*, in which six folded pleats 156 are present so as to define a pleated liner configuration 157. Each toggle-style shell fastener 132 passes through at least two receiving aperture liner fasteners 152 to temporarily mount liner 140 in small-size handbag outer shell 111*a*. FIG. 2B depicts liner 140 inserted into a medium-size handbag outer shell 111*b*, in which two folded pleats 156 are present so as to define a partially-pleated liner configuration 158. FIG. 2C depicts liner 140 inserted into a large-size handbag outer shell 111*c*, in which no folded pleats are needed so as to define a fully expanded liner configuration 159 wherein each toggle-style shell fastener 132 passes through a single receiving aperture liner fastener 152.

Figure 3:
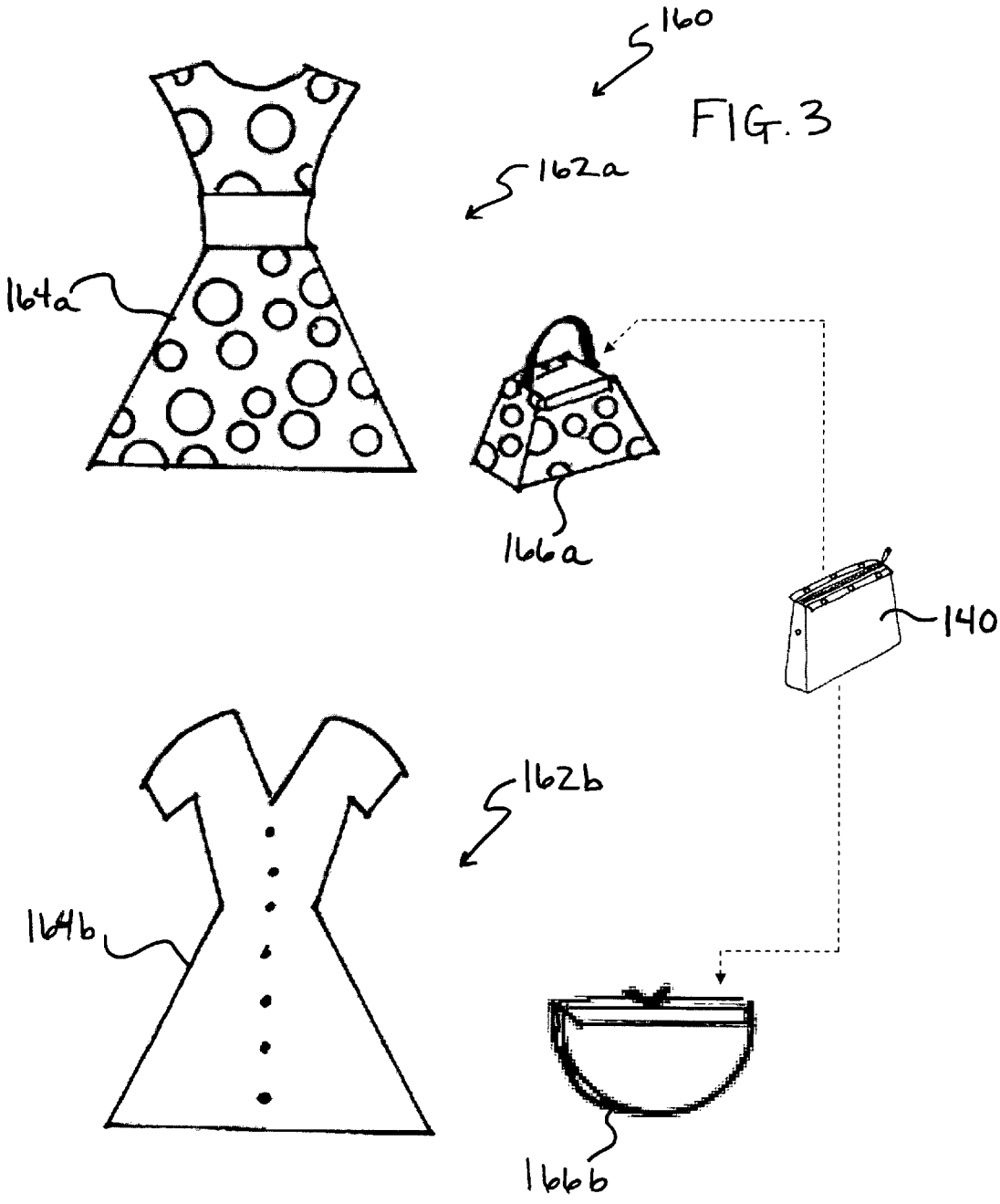
FIG. 3 is an exploded, perspective view of a fashion system according to an embodiment of the present invention.

In another representative embodiment of the present disclosure, a fashion system 160 can comprise a multiple of outfits, each outfit comprising a clothing ensemble with a corresponding handbag shell, as illustrated in FIG. 3. Each handbag shell can be adapted to receive an interchangeable handbag liner. As demonstrated in FIG. 3, first outfit 162*a* comprises a clothing ensemble 164*a* and a handbag outer shell 166*a*. Second outfit 162*b* comprises a clothing ensemble 164*b* and a handbag outer shell 166*b*. A single interchangeable handbag liner 140 can be temporarily mounted within handbag shell 166*a* and 166*b*, upon the user's preference, as described above. Handbag liner 140 can remain interchangeable throughout a change in seasons and corresponding changes to fashion design.

The handbag system of the present invention allow for a user to quickly and efficiently transfer one's belongings between different handbag styles, without the need to empty the contents of one handbag to transfer to another handbag.

The present disclosure describes aspects of one presently preferred embodiment of a handbag with an interchangeable liner. It will be understood by one of skill in the art that additional, alternative embodiments are contemplated and would not depart from the spirit and scope of the present disclosure.

What is claimed:

1. A handbag system for quickly and efficiently changing handbag styles comprising:

a first outer shell having a first inner portion, a first exterior portion, and a first shell attachment feature, the first exterior portion having a first shell style, the first outer shell including a first shell attachment area having a first attachment length;

a second outer shell having a second inner portion, a second exterior portion, and a second shell attachment feature, the second exterior portion having a second shell style, the second outer shell including a second shell attachment area having a second attachment length; and a removable liner defining an inner storage portion wherein the removable liner is adapted for both selective removal from and selective insertion into both the first inner portion and the second inner portion and wherein the removable liner includes an adjustable liner attachment area such that the removable liner can be adjusted for attachment to either the first shell attachment area or the second shell attachment area wherein the first attachment length and second attachment length are unequal, the removable liner further including a liner attachment feature adapted to removably attach to either the first or second shell attachment feature, the first and second shell attachment feature and liner attachment feature defining a toggle attachment system.

2. The handbag system of claim 1, further comprising at least a third outer shell having a third inner portion, a third exterior portion and a third shell attachment feature, the third exterior portion having a third shell style, and wherein the third outer shell includes a third shell attachment area having a third attachment length and the removable liner is adapted for selective removal from and selective insertion into the third inner portion.

3. The handbag system of claim 1, wherein the first outer shell and the second outer shell are constructed of a material selected from the group consisting of: leather, suede, vinyl, silk, cotton, straw, hemp and combinations thereof.

4. The handbag system of claim 1, wherein either or both of the first outer shell and the second outer shell comprise a decorative feature selected from the group consisting of: real gem stones, fabric patterns, imitation gem stones and decorative beads.

5. A handbag system for quickly and efficiently changing handbag styles comprising:

a first outer shell having a first inner portion and a first exterior portion, the first exterior portion having a first shell style, the first outer shell including a first shell attachment area having a first attachment length;

a second outer shell having a second inner portion and a second exterior portion, the second exterior portion having a second shell style, the second outer shell including a second shell attachment area having a second attachment length;

a removable liner defining an inner storage portion wherein the removable liner is adapted for both selective removal from and selective insertion into both the first inner portion and the second inner portion and wherein the removable liner includes an adjustable liner attachment area such that the removable liner can be adjusted for attachment to either the first shell attachment area or the second shell attachment area wherein the first attachment length and second attachment length are unequal, wherein the adjustable liner attachment area includes a plurality of pleats for selectively adjusting the length of the adjustable liner attachment area and wherein each pleat includes two liner receiving apertures for receiving a shell fastener on either the first shell attachment area or the second shell attachment area.

6. A fashion system comprising:

a first outfit having a first clothing ensemble and a first outer shell, the first clothing ensemble having a first clothing style, the first outer shell having a first inner portion and a first exterior portion, the first exterior portion having a first shell style matching the first clothing style and wherein the first exterior portion includes a first shell attachment area having a first attachment length;

a second outfit having a second clothing ensemble and a second outer shell, the second clothing ensemble having a second clothing style, the second outer shell having a second inner portion and a second exterior portion, the second exterior portion having a second shell style matching the second clothing style and wherein the second exterior portion includes a second shell attachment area having a second attachment length;

a removable liner defining an inner storage portion wherein the removable liner includes an adjustable liner attachment area is adapted for conversion to the first attachment length or the second attachment length providing for selective removal from and selective insertion into both the first inner portion and the second inner portion and wherein the adjustable liner attachment area is attached to the first shell attachment area or the second shell attachment area, wherein the adjustable liner attachment area includes a plurality of pleats for selectively adjusting the length of the adjustable liner attachment area to either the first attachment length or the second attachment length and wherein each pleat includes two liner receiving apertures for receiving a small fastener on either the first shell attachment area or the second attachment area.

7. The fashion system of claim 6, further comprising:

at least a third outfit having a third clothing ensemble and a third outer shell, the third clothing ensemble having a third clothing style, the third outer shell having a third inner portion and a third exterior portion, the third exterior portion having a third shell style matching the third clothing style and wherein the third exterior portion includes a third shell attachment area having a third attachment length such that the adjustable liner attachment area is adapted for conversion to the third attachment length such that the removable liner is adapted for both selective removal from and selective insertion into the third inner portion and wherein the adjustable liner attachment area is attached to the third shell attachment area.

8. A method for transferring belongings between handbags comprising:

removing a liner from a first handbag shell having a first style;

adjusting an adjustable liner attachment area to correspond to a second attachment length of a second shell attachment area on a second handbag shell, wherein adjusting the adjustable liner attachment area includes folding a plurality of pleats on the adjustable liner attachment area to correspond to the second attachment length;

placing the liner within a second handbag shell wherein the adjustable liner attachment area is attached to the second shell attachment area; and connecting a shell fastener on the second shell attachment area with a pair of liner receiving apertures on the adjustable liner attachment area.

9. The method of claim 8, wherein removing the liner from the first handbag shell comprises detaching a liner attachment feature on the adjustable liner attachment area from a first shell attachment feature on a first shell attachment area on the first handbag shell.

10. The method of claim 9, wherein placing the liner within the second handbag shell comprises attaching the liner attachment feature to a second shell attachment feature on the second shell attachment area on the second handbag shell.

* * * * *